United States Patent [19]

Saft

[11] 4,320,538

[45] Mar. 23, 1982

[54] WEARING APPAREL

[76] Inventor: Gilbert Saft, 1524 Flat Rock Rd., Penn Valley, Pa. 19072

[21] Appl. No.: 199,760

[22] Filed: Oct. 23, 1980

[51] Int. Cl.[3] ..... A41D 1/04; A41D 1/00

[52] U.S. Cl. ..... 2/102; 2/93; 2/97; 2/103

[58] Field of Search ..... 2/102, 108, 93, 94, 2/95, 96, 97, 87, 272, 125, 103

[56] References Cited

U.S. PATENT DOCUMENTS

| | | | |
|---|---|---|---|
| 239,818 | 4/1881 | Hacmar | 2/97 |
| 616,360 | 12/1898 | Rubin et al. | |
| 1,489,046 | 4/1924 | Thompson . | |
| 1,522,499 | 1/1925 | Corn . | |
| 1,951,478 | 3/1934 | Godard | 2/97 |
| 2,121,304 | 6/1938 | Rosenbloom | 2/103 |
| 2,122,873 | 7/1938 | Shuster | 2/126 |
| 2,128,193 | 8/1938 | Shane | 2/97 |
| 2,147,054 | 2/1939 | Pearson | 2/125 |
| 2,153,838 | 4/1939 | Jay | 2/125 |
| 2,374,643 | 5/1945 | Boettcher | 2/114 |
| 2,690,565 | 10/1954 | Cornet | 2/108 |
| 3,024,466 | 3/1962 | Agostini | 2/49 |
| 3,034,133 | 5/1962 | Eilonberg | 2/102 |
| 3,137,007 | 6/1964 | Speer | 2/76 |
| 4,006,495 | 2/1977 | Jones | 2/93 |
| 4,122,553 | 10/1978 | Pitkanen | 2/102 |
| 4,227,264 | 10/1980 | Spector et al. | 2/227 |

FOREIGN PATENT DOCUMENTS

| | | |
|---|---|---|
| 355023 | 8/1931 | United Kingdom . |
| 840421 | 7/1960 | United Kingdom . |

*Primary Examiner*—Doris L. Troutman

*Attorney, Agent, or Firm*—Seidel, Gonda, Goldhammer and Panitch

[57] ABSTRACT

The apparel is an uninsulated vest having insulated arms and adapted to be worn underneath a sleeveless insulated jacket.

7 Claims, 4 Drawing Figures

FIG. 1
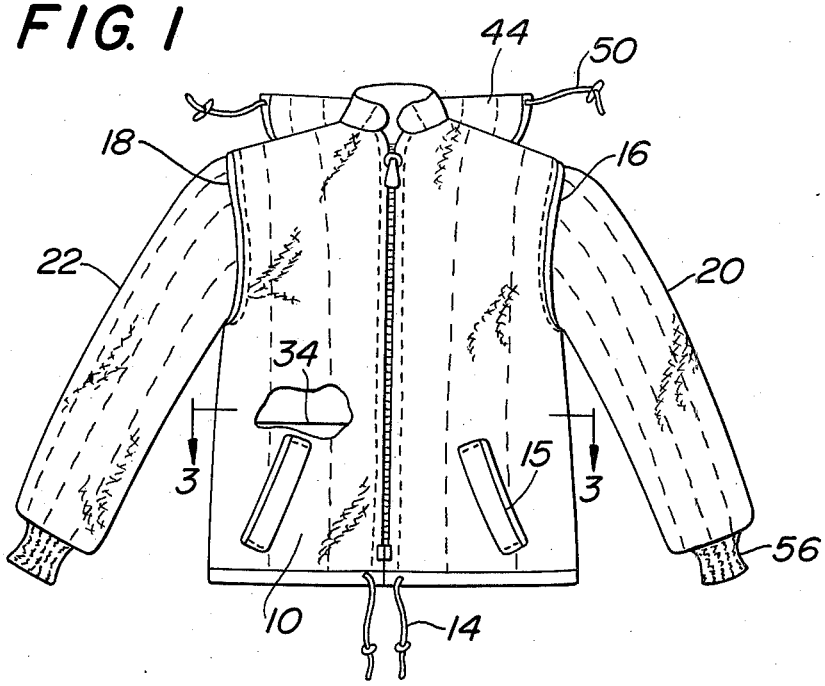
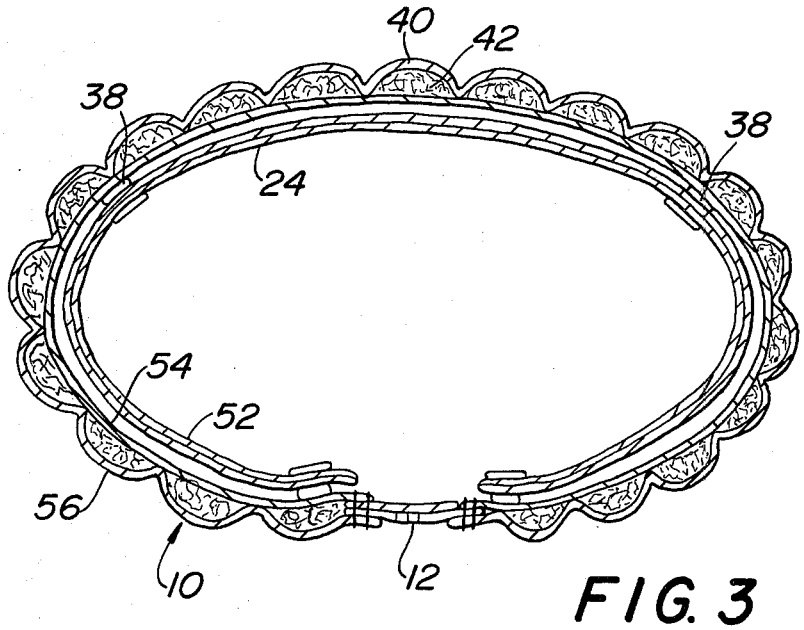
FIG. 3

WEARING APPAREL

BACKGROUND

Insulated sleeveless jackets are known and are primarily worn by persons engaged in activity requiring freedom of use of the hands such as skiing. It is known to removably attach sleeves directly to arm holes of a jacket by way of fasteners or zippers. Such removable sleeves have not been commercially successful particularly if the sleeves must be insulated. The present invention is directed to a solution to the problem of how to provide insulated sleeves for an insulated jacket without a direct connection therebetween.

SUMMARY OF THE INVENTION

The present invention is directed to wearing apparel in the form of an uninsulated vest having insulated arms. The arms are insulated by having chambers or pockets containing insulating material. The arms are integral with the uninsulated vest and are adapted to be used with a sleeveless jacket insulated in the same manner as the sleeves. In a preferred embodiment, the vest has fastener means thereon for removably securing the vest to the inside of the sleeveless jacket. Further, the vest may have means for selectively coupling vertically disposed edge portions of the vest.

It is an object of the present invention to provide novel wearing apparel in the form of an uninsulated vest having insulated arms connected thereto whereby the vest may be worn inside of aninsulated armless jacket.

It is another object of the present invention to provide an insulated armless jacket having a removable uninsulated vest connected to arms insulated in the same manner as the jacket.

It is another object of the present invention to provide wearing apparel in the form of an armless insulated jacket which can be provided with insulated arms without securing the arms directly to the jacket.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a front elevation view of an insulated armless jacket provided with insulated arms in accordance with the present invention.

FIG. 3 is a sectional view taken along the line 3—3 in FIG. 1.

Figure 2:
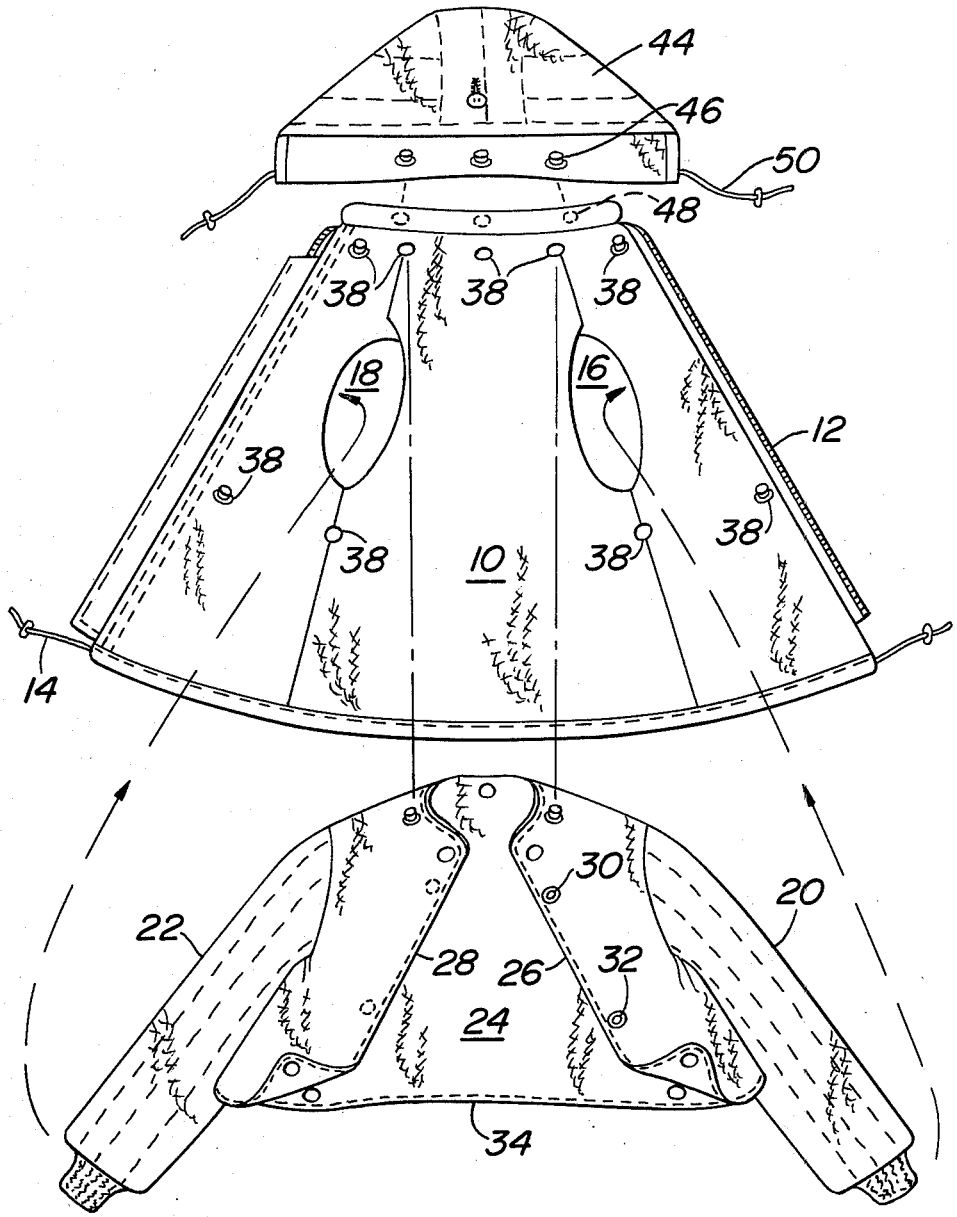
FIG. 2 is an exploded view of the jacket, vest and hood.

Referring to the drawing in detail, wherein like numerals indicated like elements, there is shown in FIG. 1 an armless insulated jacket designated generally as 10. The jacket 10 has vertical mating edge portions secured together by a faster means such as the zipper 12. The lower perimeter of the jacket 10 may be provided with tie strings 14 and pockets 16 adjacent to the lower edge.

The jacket 10 is provided with arm holes 16 and 18. A sleeve 20 extends through arm hole 16 and a sleeve 22 extends through arm hole 18. The sleeves 20 and 22 are insulated in the same manner as the jacket 10 with the same or a mating color fabric. The sleeves 20, 22 are not directly connected to the jacket 10 but instead are fixedly secured to a vest 24. The vest 24 is uninsulated. Edge portions 26 and 28 on the vest 24 may be removably coupled together in any conventional manner such as by snaps 30, 32. In addition, the outer surface of the vest 24 adjacent the lower edge 34, the edge portions 26, 28, and around the neck portion 36, there is provided fastener means such as snaps for removably securing the vest 24 to mating snaps 38 on the inner surface of the jacket 10. In this manner, the vest 24 is removably secured to the inner surface of the insulated armless jacket 10. As a result thereof, the jacket 10 is provided with removable insulated arms 20, 22 without the arms being directly connected to the jacket 10.

As shown more clearly in FIG. 3, the jacket 10 is insulated by having a plurality of chambers 40 filled with an insulating material such as down 42 or synthetic equivalents thereof. The chambers 40 may be attained by quilting type stitching or heat sealing. The arms 20, 22 are insulated in the same manner.

If desired, the jacket 10 may be provided with a removable hood 44 which is insulated in the same manner as jacket 10. Hood 44 has fasteners 46 removably mating with fasteners 48 on a collar of the jacket 10. If desired, the hood 44 may be provided with tie strings 50.

As mentioned above, the vest 24 is uninsulated. As will be apparent from FIG. 3, the vest 24 may have a lining 52 and still be considered an uninsulated vest. The jacket 10 may be provided with a lining 54 to which the outer layer 56 is stitched to thereby form the pockets or chambers 40. If desired, the sleeves 20, 22 may terminate in a cuff 56 of elastomeric material and of smaller cross-section than the adjacent sleeves. When vest 24 is worn under jacket 10, the joints between vest 24 and its sleeves are not visible.

As thusly disclosed herein, the jacket 10 may be worn by itself or with the sleeves 20, 22. The jacket 10 and vest 20 may be sold as a unit or as separates. Thus, the vest 24 with the sleeves 20, 22 connected thereto may be sold independently of the jacket 10 for use by those persons already possessing a sleeveless insulated jacket. The sleeves 20, 22 and jacket 10 may be made from the same material in the same or matching colors. Such material is preferably water repellant. A preferred material is a tightly woven nylon.

The present invention may be embodied in other specific forms without departing from the spirit or essential attributes thereof and, accordingly, reference should be made to the appended claims, rather than to the foregoing specifications, as indicating the scope of the invention.

I claim:

1. Wearing apparel comprising an uninsulated vest having arms fixedly connected thereto, said arms being insulated by having a plurality of chambers containing insulating material, the vest being adapted to be worn inside of a sleeveless insulated jacket.

2. Apparel in accordance with claim 1 including fastener means on the front of the vest for selectively coupling vertically disposed edge portions of the vest.

3. Apparel in accordance with claim 1 including fastener means adjacent the neck and lower portions of the vest for removably securing the vest to mating fastener means on the inside of a sleeveless insulated jacket.

4. Wearing apparel comprising a sleeveless insulated jacket, a vest removably secured to the inner surface of said jacket, insulated arms fixedly attached to said vest and extending through arm holes in said jacket, whereby the jacket may be worn sleeveless or with matching insulated arms without the arms being directly connected to the jacket.

5. Apparel in accordance with claim 4 wherein the height of the vest is substantially smaller than the height of the jacket.

6. Apparel in accordance with claim 5 including an insulated hood removably secured to a collar on the jacket.

7. Apparel in accordance with claim 4 wherein said vest is uninsulated, said jacket and arms being insulated by having a plurality of discrete chambers containing discrete insulating material.

* * * * *